United States Patent [19]

Flinn, Jr.

[11] 4,121,422

[45] Oct. 24, 1978

[54] POWER PLANT

[76] Inventor: Henry I. Flinn, Jr., Rte. 1, Box 170, Pittsboro, N.C. 27312

[21] Appl. No.: 828,105

[22] Filed: Aug. 26, 1977

Related U.S. Application Data

[63] Continuation-in-part of Ser. No. 725,685, Sep. 23, 1976, abandoned.

[51] Int. Cl.[2] ..... F02G 3/00; F02B 75/22

[52] U.S. Cl. ..... 60/597; 74/52; 123/55 R; 123/81 C; 123/197 R

[58] Field of Search ..... 123/55 R, 61 R, 63, 123/81 C, 65 VA, 197 R; 60/597, 624; 74/49, 52

[56] References Cited

U.S. PATENT DOCUMENTS

| | | | |
|---|---|---|---|
| 304,553 | 9/1884 | Parsons et al. | 74/49 |
| 1,579,083 | 3/1926 | Collins | 74/52 |
| 1,888,448 | 11/1932 | Brant | 74/52 |
| 2,023,250 | 12/1935 | Stalder | 74/52 |
| 2,565,368 | 8/1951 | Hammick | 123/56 BC |
| 3,175,544 | 3/1965 | Hughes | 123/55 R |

*Primary Examiner*—Louis J. Casaregola

*Attorney, Agent, or Firm*—Cushman, Darby & Cushman

[57] ABSTRACT

An internal combustion two stroke engine is provided having at least one cylinder within which a piston reciprocates. The engine is joined to a gear box which includes a ring gear. A pair of gears having diameters half that of the ring gear move within the latter. At least one of said pair of gears is connected to a piston by a pin extending between the piston and the periphery of said gear. An additional pair of gears are fixed to respective ones of the first-mentioned gear pair and are operatively joined to a pinion to which a drive shaft is secured. A turbine and filter arrangement is positioned on the side of the engine opposite the gear box whereby exhaust gases from the engine are directed to the turbine to develop power at an output drive shaft joined to the turbine and to filter pollutants from the gases.

37 Claims, 7 Drawing Figures

POWER PLANT

BACKGROUND OF THE INVENTION

This is a continuation-in-part of Application Ser No. 725,685 filed Sept. 23, 1976, now abandoned.

It has long been an objective to reduce the weight and space requirements of power plants, particularly those used for motor vehicles. Nevertheless, such efforts have met with only limited success for when the power plants are reduced in size or are mechanically simplified, the resultant output from such power plants has been limited and difficulties have been encountered in converting the movement of the engine parts into effective operation of a drive shaft.

One type of engine of simplified construction which has been previously proposed is that described in U.S. Pat. No. 3,175,544 which issued on Mar. 30, 1965 to James W. Hughes. This engine comprises a pair of cylinders arranged such that their longitudinal axes intersect at a 90° angle. Pistons reciprocate in each of the cylinders. The center points of the pistons are connected by links which serve to operate a crankshaft. However, such an arrangement suffers a number of shortcomings. For example, the crankshaft linkage of Hughes (generally known as a scotch yoke) has a considerable number of duplicated parts which are complicated, expensive, relatively inaccessible for servicing and which contribute significantly to the overall weight of the engine.

The present invention overcomes the deficiencies of the type noted with respect to the arrangement disclosed in U.S. Pat. No. 3,175,544. More particularly, an engine of the general type disclosed in the aforesaid patent is combined with a gear arrangement which permits the power developed by the engine to be efficiently converted to rotary movement of a drive shaft. The relationship of the gears permits their being housed in a gear box which, together with the engine, form an extremely small package. As a result, a power plant is produced which is compact, lightweight, efficient and easy to service. In the case where the power plant is used in a motor vehicle, the structure is such that it can be positioned very close to the road thereby allowing the center of gravity of the vehicle to be substantially lowered.

While it is generally known (for example in U.S. Pat. No. 2,565,368 granted on Aug. 21, 1957 to Frederick C. Hammick) to direct exhaust gases from an engine cylinder onto a vaned impeller in order to supplement the engine output, the structure of the present invention permits such a concept to be employed in combination with an exhaust gas filtering arrangement without substantially increasing the size, weight and complexity of the overall assembly of the power plant. As a result, power from the engine which otherwise is wasted is made available to operate various accessories external of the engine.

SUMMARY OF THE INVENTION

The invention includes an internal combustion two stroke engine which comprises at least one cylinder within which a piston reciprocates as a result of fuel combustion occurring at controlled intervals at opposite ends of the cylinder. A pin connected to the piston passes through the cylinder wall to enter a gear box where it joins the periphery of a gear mounted for movement with respect to an internally toothed ring gear. The moving gear has a diameter half that of the ring gear whereby the straight line movement of the pin during piston reciprocation results in the attached gear being moved in a rotating fashion along the entire internal periphery of the ring gear. An additional gear is fixed to the movable gear to translate the rotation of the latter to a pinion to which a drive shaft is connected. As a result, the reciprocating movement of the engine piston is converted into rotation of the drive shaft.

The arrangement of the engine and gear box is supplemented by a turbine and filter arrangement positioned on the opposite side of the engine from said gear box. Exhaust gases discharged from the engine are directed onto a vaned impeller causing it to rotate. Thus, an additional drive shaft joined to the impeller produces further power output from the engine. A filtering arrangement surrounds the impeller so that the pollutants in gases directed centrifugally from the impeller are trapped in the filter.

A preferred embodiment of a complete power plant suitable for use on a motor vehicle will not be described in detail with respect to the accompanying drawings wherein.

Figure 2:
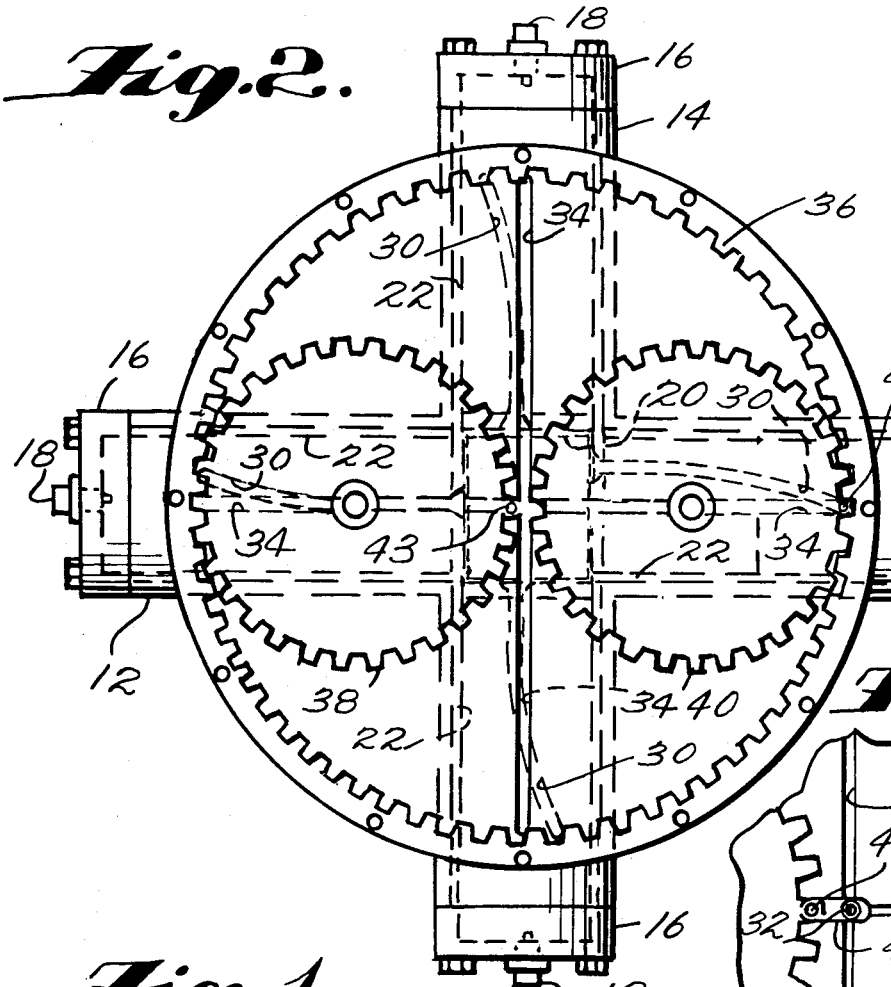
FIG. 2 is a sectional view taken along line 2—2 of FIG. 1.
Figure 2B:
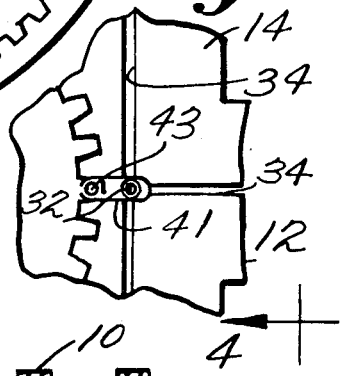
Figure 1:
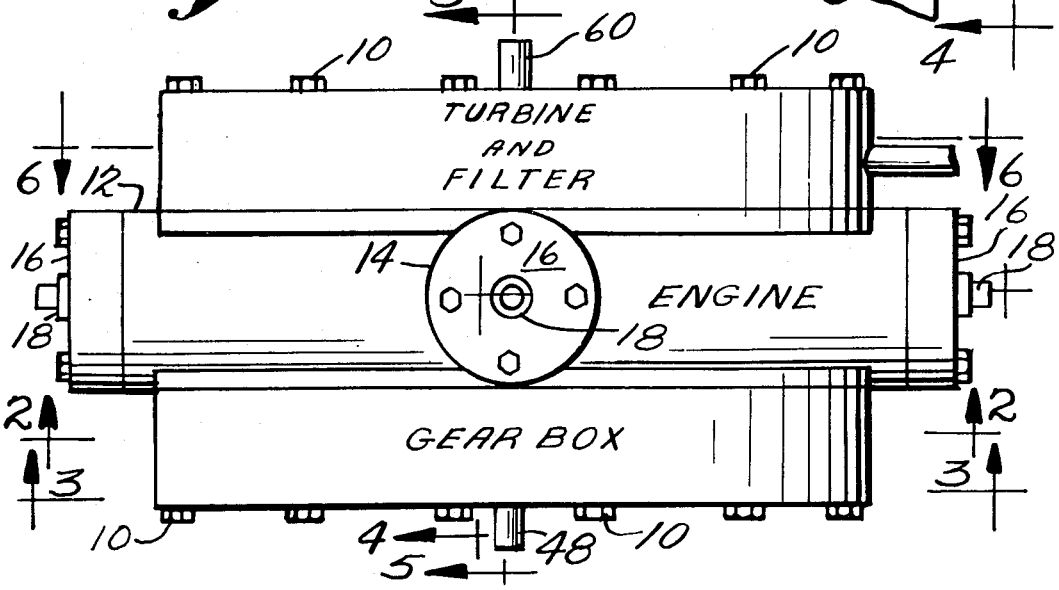
FIG. 1 is a side elevational view illustrating the basic elements of the power plant.
Figure 2A:
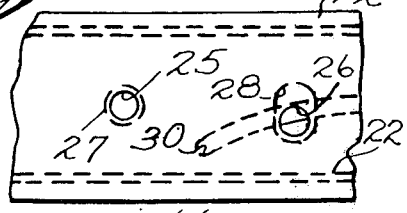
Figure 5:
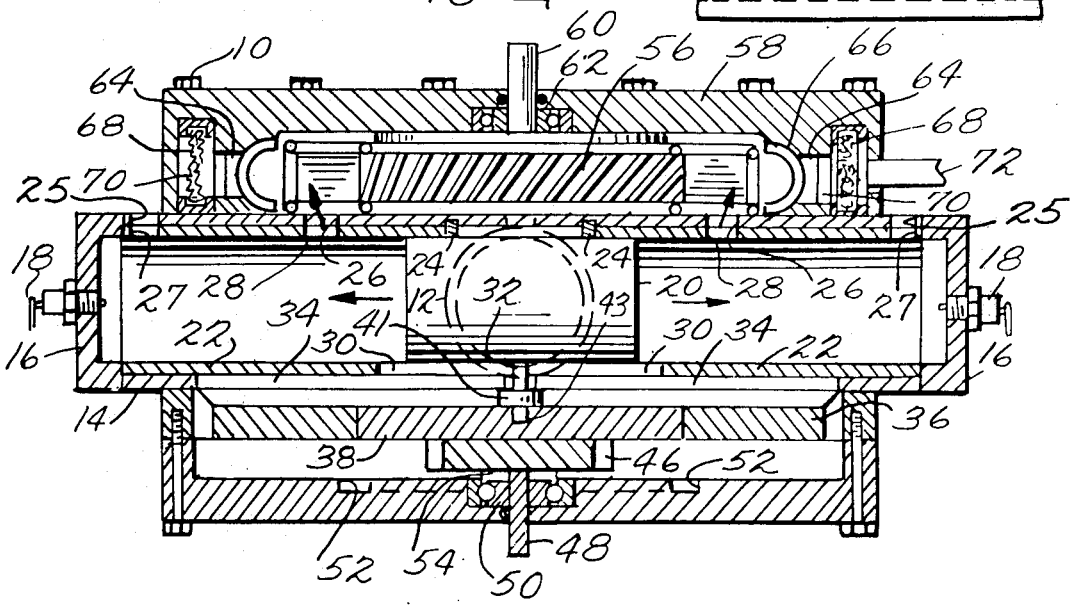
Figure 3:
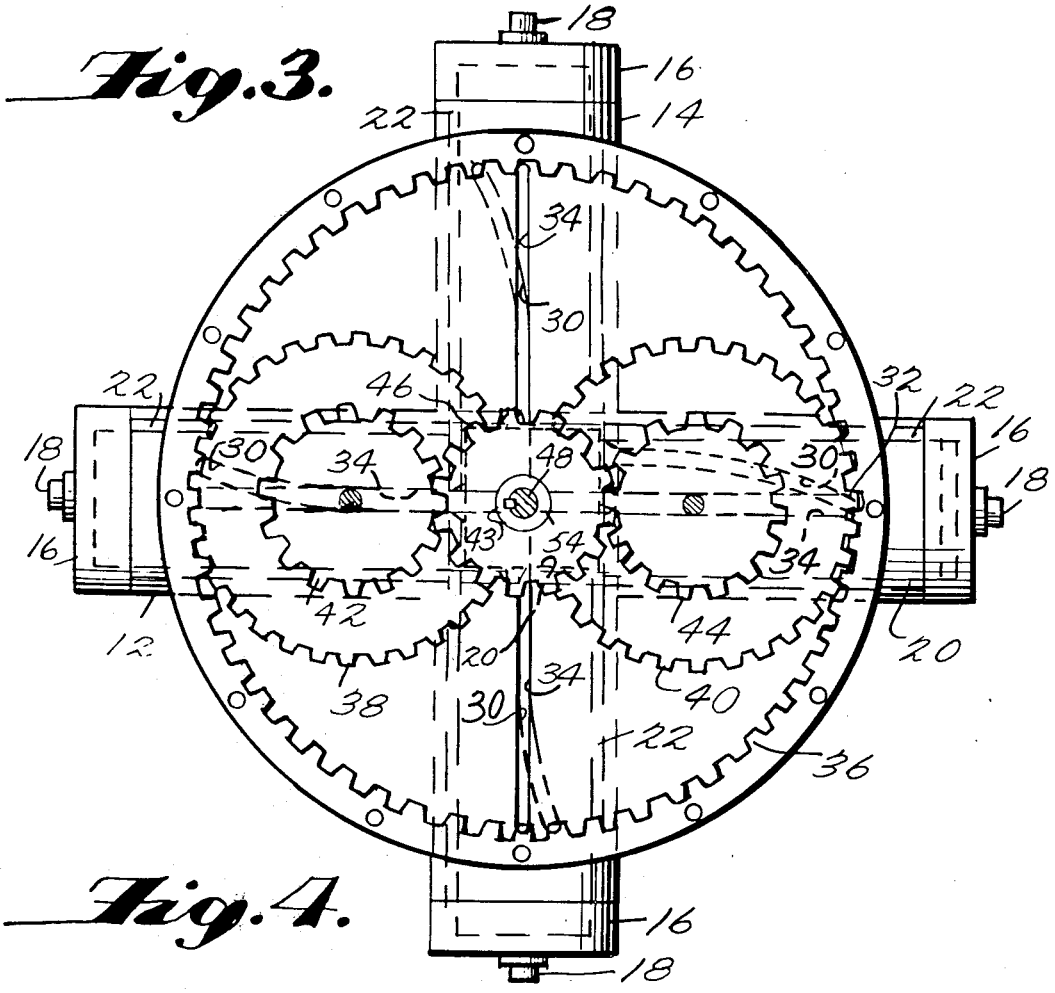
Figure 4:
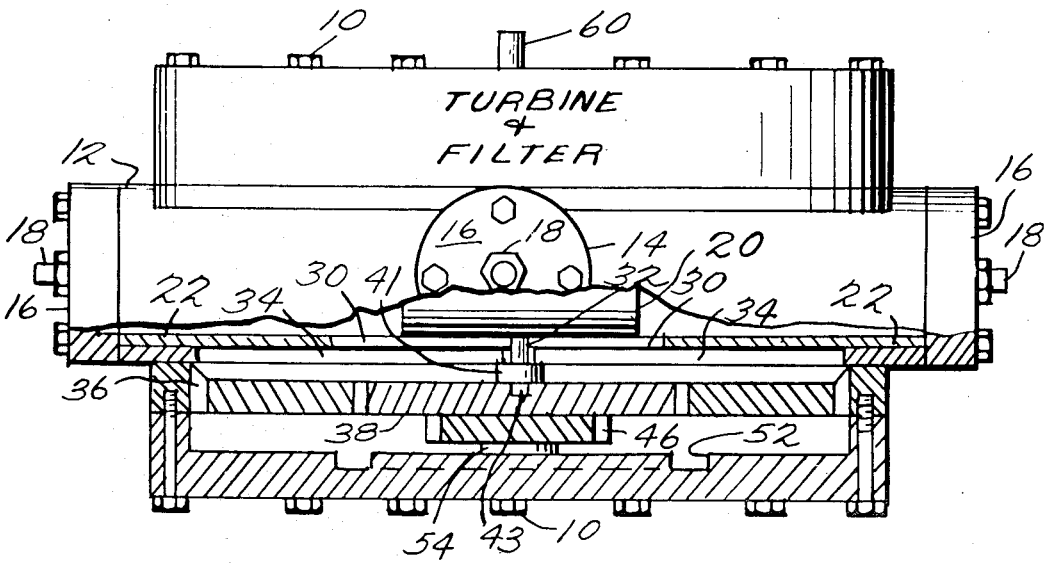

FIG. 2*a* is an enlarged fragmented top view of a portion of the cylinder and cylinder sleeve arrangement shown in FIG. 2;

FIG. 2*b* is an enlarged fragmented view of a portion of the mechanical linkage shown in FIG. 2;

FIG. 3 is a sectional view taken along line 3—3 of FIG. 1;

FIG. 4 is a fragmented side elevational view taken substantially along line 4—4 of FIG. 1;

FIG. 5 is a sectional view taken along line 5—5 of FIG. 1; and

Figure 6:
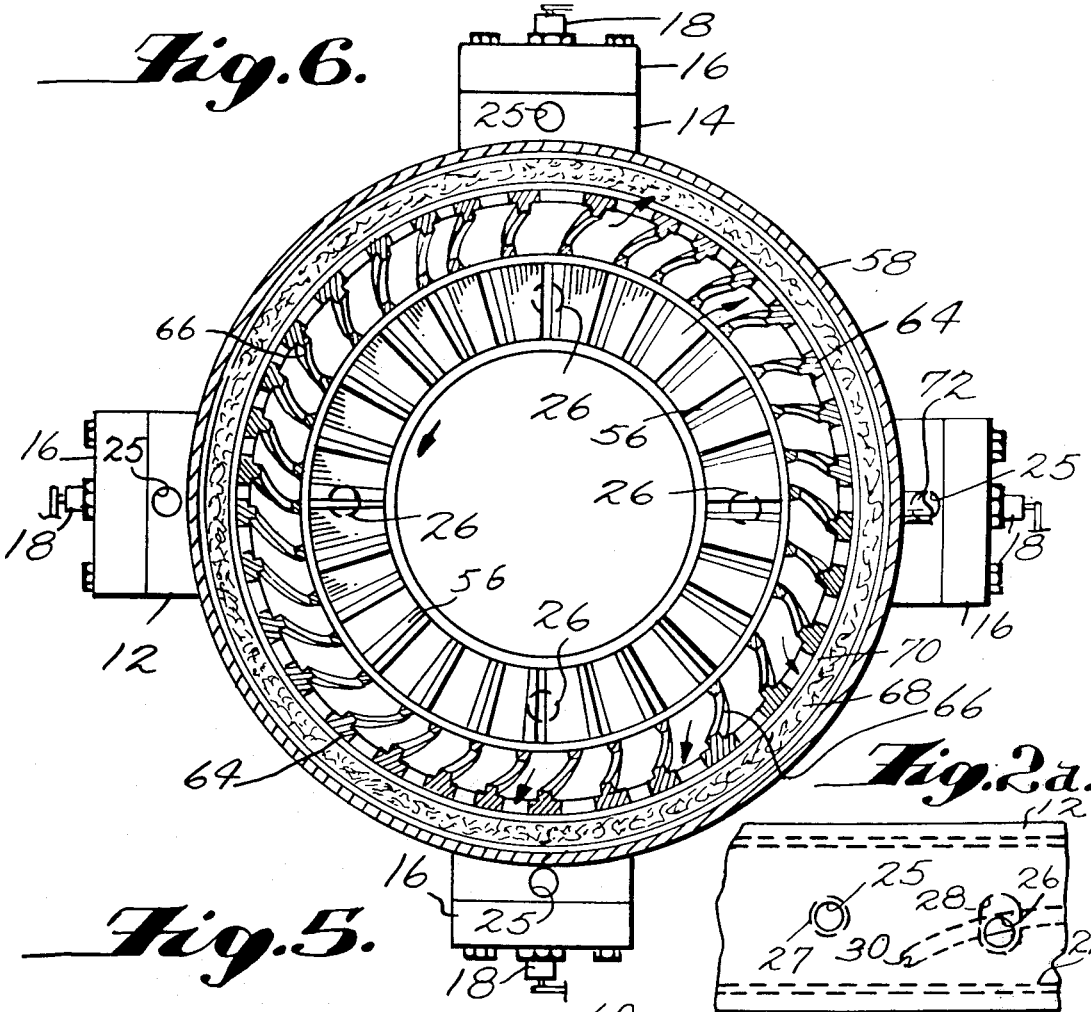

FIG. 6 is a sectional view taken along line 6—6 of FIG. 1.

DETAILED DESCRIPTION OF THE INVENTION

Referring to the drawings, the invention will be described in detail. FIG. 1 illustrates the general arrangement of a power plant comprising a two stroke engine arrangement positioned between a turbine and a gear box. These components are held together as an assembly in a conventional manner as, for example, by bolts 10 extending into appropriately positioned apertures in the housings of the turbine, engine and gear box.

As can be appreciated from FIGS. 1-3, the engine comprises a pair of cylinders 12 and 14 having their longitudinal axes intersecting at right angles. The ends of each cylinder are provided with removable caps 16 which serve as supports for spark plugs 18 having spark gaps positioned within the cylinders.

A piston 20 is provided in each of the cylinders. The pistons reciprocate within the cylinders in accordance with combustion of fuel introduced adjacent the ends of the cylinders by conventional fuel injection means (not shown) and ignited by the spark plugs 18 in a firing order which is timed in a conventional manner. The pistons move within cylindrical sleeves 22 in the cylinders. Each cylinder contains two sleeves extending from opposite ends of the cylinder towards the points of intersection with the other cylinder. The sleeves terminate in chamfered ends adjacent the intersections and are restrained against longitudinal movement by the removable caps 16 and stop elements 24 (FIG. 5) which project from annular grooves provided in the inner surfaces of the cylinders 12 and 14. The stop elements 24 are of generally circular configuration except where interrupted to permit the passage of a piston pin which now will be described.

As the piston 20 reciprocates within its respective cylinder, it is necessary to appropriately introduce air for combustion and exhaust combustion gases. This is accomplished by providing pairs of axially aligned inlet ports 25 and exhaust ports 26 in each cylinder at spaced locations from the ends of the cylinders (FIG. 5). The sleeves 22 are rotatable about their longitudinal axes to permit apertures 27 and 28 therein to be brought into alignment with ports 25 and 26, thereby providing open paths from the interior of the sleeves to the exterior of the engine. Rotation of the sleeves within their respective cylinders is selectively accomplished, in timed relationship with fuel combustion and movement of the associated piston 20, by means of slots 30 in the sleeves within which projecting piston pin 32 (FIG. 4) rides as the piston reciprocates. Referring to FIG. 2*a*, each of the slots 30 is configured such that as the pin 32 engages a slot 30 during a compression stroke, the sleeve is rotated to move its apertures 27 and 28 out of alignment with ports 25 and 26, whereas after combustion, with the piston moving in a direction opposite to that of the compression stroke, the pin 32 causes the sleeve to rotate in the reverse direction to align apertures 27 and 28 with ports 25 and 26 so as to allow the exhaust gases to exit from the cylinder and fresh air to be introduced thereto. As can be appreciated from FIG. 2*a*, aperture 28 is elongated along an axis extending transversely to the longitudinal axis of the sleeve. Accordingly, during a compression stroke the sleeve rotates causing the inlet port 27 to be closed slightly before the exhaust port is fully closed, whereas during a power stroke following combustion, the sleeve rotates in the opposite direction to cause the exhaust port to begin to open prior to the opening of the inlet port. Each piston 20 is restrained from rotation about its longitudinal axis during reciprocation by extending its associated pin 32 through an elongated slot 34 in the cylinder. While a major portion of the length of each slot 34 is sealed by the body of its respective sleeve 22 (FIGS. 4 and 5), it can be seen from these Figures that an overlap occurs between slots 30 and 34 when the piston is located midway between the ends of its respective cylinder. However, this does not adversely affect the compression or power strokes of the engine. This is because the pin 32 is located intermediate the ends of piston 30. Consequently, as the piston moves to a position wherein ports 25 and 26 are closed and compression occurs, the space between the end face of the piston and the end of the cylinder is completely sealed by the sleeve. Similarly, during the power stroke, this seal is maintained until ports 25 and 26 open to release the bulk of the exhaust gases and introduce fresh air to the cylinder.

During operation of the engine, the order and timing of ignition of spark plugs 18 is established such that the pistons 20 reciprocate within cylinders 12 and 14 without interference at the cross-over position where the cylinders intersect. This requires that when one piston is at the end of a compression stroke, the other piston is substantially in the middle of its movement from one end of its associated cylinder to the other. As stated previously, when a given piston moves towards one end of a cylinder the air inlet and exhaust ports 25 and 26 thereat are closed by rotation of the associated sleeve 22, and that cylinder end is placed in the compression state in preparation for combustion. Simultaneously, the opposite end of the cylinder is being relieved of combustion gases and supplied with fresh air since rotation of its sleeve has brought its apertures 27 and 28 into alignment within an exhaust port 26 and inlet port 25.

The manner by which the reciprocating motion of the pistons 20 is translated into rotation of a drive shaft will be described with particular reference to FIGS. 2–5.

Within the gear box a stationary ring gear 36 is provided, the gear having on its interior periphery a plurality of teeth. These teeth are inclined with respect to the principal plane of the gear (see FIGS. 4 and 5). Ring gear 36 cooperates with a pair of additional gears 38 and 40 which also are provided with inclined teeth machined to engage those of gear 36. The number of teeth formed in gears 36, 38 and 40, and the diameters of gears 38 and 40, are selected such that the loci of the teeth of gears 38 and 40 describe straight lines as these gears simultaneously rotate within ring gear 36. More particularly, the diameters of gears 38 and 40 are half that of the ring gear 36, and the teeth in gear 36 are an even number which is twice that of either of gears 38 and 40. Rotation of gears 38 and 40 is achieved by rotatably connecting pin 32 of each piston to a link 41 to which a further pin 43 also is connected (FIG. 2*b*). Pins 43 are joined to a tooth of respective gears 38 and 40. With the pistons 20 positioned as shown in FIGS. 2 and 3, one of the pins 43 is secured to a tooth on gear 38 which is located on the diametrically opposite side of gear 40 from the tooth of gear 40 to which the other pin 43 is connected. When so positioned, the pins 32 and 43 associated with the respective pistons move in paths at right angles to one another.

An additional pair of gears 42 and 44 are joined in fixed coaxial relationship with gears 38 and 40, respectively, (FIG. 3). These additional gears are of smaller diameter than gears 38 and 40 so as to receive therebetween a pinion 46 to which an output drive shaft 48 is connected. The drive shaft is supported by a conventional bearing and seal arrangement 50 as it passes through the gear box housing (FIG. 5). The pinion 46 engages the teeth of gears 42 and 44 whereby when gears 38 and 40 are caused by the engine to rotate within ring gear 36, the rotation is translated by gears 42 and 44 into rotation of pinion 46 and drive shaft 48. The speed of rotation of shaft 48 is a function of the operating speed of the engine, the gear sizes, etc.

In order to assist in properly maintaining the operating position of gears 38, 40, 42 and 44 as they move with respect to ring gear 36, the housing of the gear box may include an annular groove 52 for receiving a stub 54 which projects from the center of each of the gears 42 and 44, the stubs having a portion of greater width than groove 52 in the space between the gears 42 and 44 and the gear box housing. This arrangement is illustrated in FIGS. 4 and 5.

As described previously, the combustion gases are exhausted from the engine via ports 26. These gases which contain energy which normally is wasted, are utilized by the turbine which is shown in detail in FIGS. 5 and 6. More particularly, the turbine comprises a vaned impeller 56 supported for rotation in a conventional manner within the turbine housing 58. The impeller is dimensioned such that the vanes overlay the exhaust ports 26. Consequently, when exhaust gases exit from the engine through the ports, the impeller 56 is rotated. It is believed that this rotation tends to develop a partial vacuum above the ports which assists in drawing the exhaust gases from the engine and introducing fresh air thereto in the manner which has been described above. A drive shaft 60 is joined to the impeller to rotate therewith. Shaft 60 is supported by a conventional bearing and seal arrangement 62 as it passes through housing 58. The rotation of shaft 60 may be utilized to power auxiliary equipment such as a generator or an alternator.

The turbine is also provided with means to control the emissions in the gases exhausted from the engine. More particularly, the impeller 56 is surrounded by an opensided collar 64 which supports a series of arcuate ribs 66 which are inclined with respect to the principal plane of the collar. A ring of filter material 68 surrounds the collar 64 and communicates therewith via a passage 70 defined within the turbine housing 58. The material used may be any of a number of available products designed to filter pollutant particles. For example, the Matsushita Electrical Industrial Co., Ltd. of Osaka, Japan, produces a chemical reagent called Maclean, containing sodium chlorite and an alkali, bound together with cement, which removes nitrogen and sulfur oxides from air passing through the material. The filter ring communicates with atmosphere through one or more vents 72 so as to permit gases passing through the filter 68 to escape from the turbine.

In operation, the combustion exhaust gases exiting the engine via ports 26 impinge upon the vanes of the impeller 56. These vanes are oriented to cause the impeller to be rotated by the gases in a counterclockwise direction. Rotation of the impeller hurls the gases through the open inner sides of collar 64 against the ribs 66, causing the gases to be diffused. These gases then pass through the open outer sides of collar 64 and passage 70 into the filter material 68 where pollutant particles are trapped. The cleaned gases thereafter excape to atmosphere via vent(s) 72. However, if desired, these gases may be directed from vent(s) 72 to be mixed with fresh air and returned to the engine through inlet ports 25.

The structure just described provides an extremely compact power plant having a small number of working parts. Easy access is permitted to the interior of the assembly since it is only necessary to remove the gear box and turbine housings in order to expose the various gears, filter ring, diffuser collar, impeller, etc. The removable caps 16 at the ends of the engine cylinders also permit the spark plugs 18, pistons 20 and sleeves 22 to be easily serviced or replaced.

While the preferred embodiment of the invention has been described as including an engine having a pair of cylinders each having a piston therein, it should be appreciated that a single cylinder version of the invention also is possible. Since such an arrangement would only employ a single piston 20, it would be necessary to have only one sleeve valve 22 within the cylinder. Of course, this valve would include an appropriately oriented slot 30 for controlling the opening of the inlet and exhaust ports, in the manner set forth above. In a single cylinder arrangement, the gear box would remain as previously described except that only one of the gears 38 and 40 would be driven by a pin 43 linked to the pin 32 from the single piston 20. Nevertheless, due to the presence of operatively interconnected gears 42 and 44 and pinion 46, the other of the gears 38 and 40 would be indirectly driven so that both gears 38 and 40 would move with respect to ring gear 36 in the manner discussed with respect to the two cylinder embodiment. Accordingly, all elements of the gear box assembly would be retained in precisely the same physical relationship and power would be delivered to the drive shaft 48.

The power plant has been described as being the main driving source for a motor vehicle. However, it also may serve as an auxiliary driving means for an electrically operated vehicle. In the latter case, use of the power plane would occur when the charge of the batteries is low. The output of drive shafts 48 and/or 60 would serve to power means for renewing the charge of the batteries. Furthermore, the power plant may be used in non-motor vehicle applications, e.g., as marine or aircraft propulsion systems, as a stationary generator, and in other power applications.

Although the turbine arrangement previously described in connection with FIGS. 5 and 6 operates to power output shaft 60 whenever the turbine impeller rotates, it may be desirable in various applications to selectively connect the impeller to the drive shaft. This may be accomplished by a suitable clutch arrangement interposed between the impeller and shaft. Such a clutch may operate, for example, when the rotational speed of the impeller reaches a predetermined level, so as to cause engagement of the drive shaft.

The power plant which has been described is cooled by air flow past the device. The most intensive heat encountered obviously is within the engine. However, tests of internal combustion engines employing a sleeve valve, reported for example in an article entitled "A Trick Up His Sleeve" by Charles Fox appearing in the July, 1974 issue of *Car And Driver,* indicate that temperatures of approximately 150° C. are experienced at the sleeve valve and cylinder head. Such temperatures are entirely manageable in the present invention wherein:

1. the cylinders are exposed to the flow of air past the power plant; and 2. the turbine draws the bulk of the hot exhaust gases from the engine, as previously explained.

As to lubrication, the aforesaid article from *Car And Driver* points out that tests of a sleeve valve-type internal combustion engine have demonstrated that presently available detergent oils prevent build-up of carbon within the engine, and the rotation of the sleeve during operation assists in spreading oil to those areas of the engine subject to wear. Of course, the gear box is lubricated in a conventional manner.

I claim:

1. A power plant comprising an internal combustion engine operatively related to a gear box, wherein said engine includes;

a cylinder;

a piston positioned within said cylinder;

fuel combustion means located at opposite ends of the cylinder and operable to reciprocate the piston within the cylinder; and a pin projecting from said piston through a slot in the cylinder which extends in a straight line parallel to the axis of the cylinder;

and wherein said gear box includes:

a stationary ring gear having teeth along the internal periphery thereof;

a first pair of gears provided with teeth engaging the teeth of the ring gear, each of said pair of gears having a diameter which is half that of the internal diameter of the ring gear;

means connecting said pin to the periphery of one of the gears of said pair;

a second pair of gears arranged coaxially with respective ones of said first gear pair for rotation therewith, said gears of the second pair having diameters less than those of the first pair; and a pinion positioned between said second pair of gears in operative relationship therewith whereby reciprocation of said piston is converted by the gear box to rotation of the pinion.

2. A power plant as set forth in claim 1, wherein the teeth in said ring gear are of an even number which is twice that of the teeth in each of the gears of said first pair.

3. A power plant as set forth in claim 1, wherein the teeth of said ring gear and the first pair of gears are inclined with respect to the principal planes of the respective gears.

4. A power plant as set forth in claim 3, wherein said pin connecting means is joined to an inclined tooth of one of the gears of said first pair.

5. A power plant as set forth in claim 1, further comprising:

a second cylinder intersecting and crossing the first-mentioned cylinder at right angles thereto, said fuel combustion means also being located at opposite ends of said second cylinder;

a second piston positioned within said second cylinder and arranged to reciprocate therein in response to operation of said fuel combustion means;

an additional pin projecting from said second piston through a slot in said second cylinder which extends in a straight line intersecting the first-mentioned slot at right angles; and means connecting said additional pin to the periphery of the other of the gears of said first pair.

6. A power plant as set forth in claim 5, wherein said pins project from the respective pistons at points substantially midway of the length of said pistons.

7. A power plant as set forth in claim 6, wherein the teeth of said ring gear and the first pair of gears are inclined with respect to the principal planes of the respective gears.

8. A power plant as set forth in claim 7, wherein said connecting means for each of the pins is joined to an inclined tooth of a respective one of the gears of said first pair.

9. A power plant as set forth in claim 5, wherein the teeth in said ring gear are of an even number which is twice that of the teeth in each of the gears of said first pair.

10. A power plant comprising an internal combustion engine operatively related to a gear box wherein said engine includes:

a cylinder provided with at least one exhaust port;

sleeve valve means located within the cylinder in coaxial relationship therewith and having at least one aperture therein;

a piston positioned within said cylinder;

fuel combustion means located at opposite ends of the cylinder and operable to reciprocate the piston within the sleeve valve means and the cylinder; and a pin projecting from said piston through slots in the sleeve valve means and the cylinder, the slot in the cylinder extending in a straight line parallel to the axis of the cylinder, and the slot in the sleeve valve means deviating at least partially from a straight line path parallel to the axis of the sleeve valve means whereby when the piston reciprocates, the sleeve valve means is rotatably displaced with respect to the cylinder to move said aperture into and out of registration with said exhaust port;

and wherein said gear box includes:

a stationary ring gear having teeth along the internal periphery thereof;

a first pair of gears provided with teeth engaging the teeth of the ring gear, each of said pair of gears having a diameter which is half that of the internal diameter of the ring gear;

means connecting said pin to the periphery of one of the gears of said pair;

a second pair of gears arranged coaxially with respective ones of said first gear pair for rotation therewith, said gears of the second pair having diameters less than those of the first pair; and a pinion positioned between said second pair of gears in operative relationship therewith whereby reciprocation of said piston is converted by the gear box to rotation of the pinion.

11. A power plant as set forth in claim 10 wherein the teeth in said ring gear are of an even number which is twice that of the teeth in each of the gears of said first pair.

12. A power plant as set forth in claim 10 wherein the teeth of said ring gear and the first pair of gears are inclined with respect to the principal planes of the respective gears.

13. A power plant as set forth in claim 12, wherein said pin connecting means is joined to an inclined tooth of one of the gears of said first pair.

14. A power plant comprising an internal combustion engine operatively related to a gear box, wherein said engine includes:

a first cylinder;

a second cylinder intersecting and crossing said first cylinder at right angles thereto whereby each of said cylinders is divided into portions separated by an area common to both cylinders;

an exhaust port in each of said cylinder portions;

a sleeve valve located within each cylinder portion in coaxial relationship with its respective cylinder, each sleeve valve having an aperture therein;

a piston positioned within each cylinder;

fuel combustion means located at opposite ends of the cylinders and operable to reciprocate the pistons within their associated cylinders and sleeve valves; and a pin projecting from each piston through slots in the sleeve valves and the cylinders, the slots in the respective cylinders extending in straight lines parallel to the cylinder axes and at right angles to one another, and the slots in the sleeve valves deviating at least partially from straight line paths parallel to the axes of the sleeve valves whereby when the pistons reciprocate, the sleeve valves are rotatably displaced with respect to their associated cylinder to move their apertures into and out of registration with their associated exhaust ports;

and wherein said gear box includes:

a stationary ring gear having teeth along the internal periphery thereof;

a first pair of gears provided with teeth engaging the teeth of the ring gear, each of said pair of gears having a diameter which is half that of the internal diameter of the ring gear;

means connecting said pins to the peripheries of respective ones of the gears of said pair;

a second pair of gears arranged coaxially with respective ones of said first gear pair for rotation therewith, said gears of the second pair having diameters less than those of the first pair; and a pinion positioned between said second pair of gears in operative relationship therewith whereby reciprocation of said pistons is converted by the gear box to rotation of the pinion.

15. A power plant as set forth in claim 14, wherein the teeth in said ring gear are of an even number which is twice that of the teeth in each of the gears of said first pair.

16. A power plant as set forth in claim 14, wherein said pins project from the respective pistons at points substantially midway of the length of said pistons.

17. A power plant as set forth in claim 16, wherein the teeth of said ring gear and the first pair of gears are inclined with respect to the principal planes of the respective gears.

18. A power plant as set forth in claim 17, wherein said connecting means for each of the pins is joined to an inclined tooth of a respective one of the gears of said first pair.

19. A power plant as set forth in claim 14, further comprising a turbine located on the opposite side of said engine from the gear box, said turbine comprising:

an impeller having vanes positioned adjacent to the exhaust ports to receive engine combustion gases when the ports are in registry with the sleeve valve apertures; and an output shaft joined to said impeller.

20. A power plant as set forth in claim 19, further comprising a ring of filter material located beyond the periphery of the impeller to receive said combustion gases after deflection by the impeller vanes.

21. A power plant as set forth in claim 20, further comprising an open-sided diffuser collar interposed between the impeller and the filter material, said collar including a plurality of spaced arcuate ribs positioned to diffuse combustion gases deflected from the impeller vanes and passing through said open sides to the filter material.

22. A power plant comprising an internal combustion engine operatively related to a gear box, wherein said engine includes:

a cylinder provided with at least one exhaust port;

a piston positioned within said cylinder;

fuel combustion means located at opposite ends of the cylinder and operable to reciprocate the piston within the cylinder;

a valve located proximate the exhaust port;

and a pin projecting from said piston through a slot in the cylinder which extends in a straight line parallel to the axis of the cylinder said pin interacting with cam means to actuate the valve to thereby selectively open and close said port in accordance with the position of said piston;

and wherein said gear box includes:

a stationary ring gear having teeth along the internal periphery thereof;

an additional gear provided with teeth engaging the teeth of the ring gear, said additional gear having a diameter which is half that of the internal diameter of the ring gear;

means connecting said pin to the periphery of said additional gear; and rotatable means arranged coaxially with said ring gear and operatively joined to said additional gear whereby reciprocation of said piston is converted by the gear box to rotation of the rotatable means.

23. A power plant as set forth in claim 22, wherein said additional gear comprises one of a pair of gears having teeth engaging the teeth of the ring gear, each of said pair of gears having a diameter which is half that of the internal diameter of the ring gear, and each of said pair of gears being operatively joined to the rotatable means.

24. A power plant as set forth in claim 23, wherein the teeth in said ring gear are of an even number which is twice that of the teeth in each of the gears of said pair.

25. A power plant as set forth in claim 23, wherein the teeth of said ring gear and the pair of gears are inclined with respect to the principal planes of the respective gears.

26. A power plant as set forth in claim 25, wherein said pin connecting means is joined to an inclined tooth of one of the gears of said pair.

27. A power plant as set forth in claim 23, further comprising:

a second cylinder intersecting and crossing the first-mentioned cylinder at right angles thereto, said second cylinder being provided with at least one exhaust port and having fuel combustion means located at opposite ends thereof;

a second piston positioned within said second cylinder and arranged to reciprocate therein in response to operation of said fuel combustion means;

a further valve located proximate the exhaust port associated with said second cylinder;

an additional pin projecting from said second piston through a slot in said second cylinder which extends in a straight line intersecting the first-mentioned slot at right angles, said additional pin also interacting with cam means to actuate the further valve to thereby selectively open and close the exhaust port associated with said second cylinder in accordance with the position of the second piston; and means connecting said additional pin to the periphery of the other of the gears of said pair.

28. A power plant as set forth in claim 27, wherein said pins project from the respective pistons at points substantially midway of the length of said pistons.

29. A power plant as set forth in claim 22, wherein:

said valve comprises a sleeve located within the cylinder in coaxial relationship therewith and having at least one aperture therein, said pin projecting from the piston through a slot in the sleeve which deviates at least partially from a straight line path parallel to the axis of the sleeve whereby when the piston reciprocates, the sleeve is rotatably displaced with respect to the cylinder to move said aperture into and out of registration with said exhaust port.

30. A power plant comprising an internal combustion engine operatively related to a gear box, wherein said engine includes:

a first cylinder;

a second cylinder intersecting and crossing said first cylinder at right angles thereto whereby each of said cylinders is divided into portions separated by an area common to both cylinders;

an exhaust port in each of said cylinder portions;

a sleeve valve located within each cylinder portion in coaxial relationship with its respective cylinder, each sleeve valve having an aperture therein;

a piston positioned within each cylinder;

fuel combustion means located at opposite ends of the cylinders and operable to reciprocate the pistons within their associated cylinders and sleeve valves; and a pin projecting from each piston through slots in the sleeve valves and the cylinders, the slots in the respective cylinders extending in straight lines parallel to the cylinder axes and at right angles to one another, and the slots in the sleeve valves deviating at least partially from straight line paths parallel to the axes of the sleeve valves whereby when the pistons reciprocate, the sleeve valves are rotatably displaced with respect to their associated cylinder to move their apertures into and out of registration with their associated exhaust ports;

and wherein said gear box includes:

a stationary ring gear having teeth along the internal periphery thereof;

a pair of gears provided with teeth engaging the teeth of the ring gear, each of said pair of gears having a diameter which is half that of the internal diameter of the ring gear;

means connecting said pins to the peripheries of respective ones of the gears of said pair; and rotatable means arranged coaxially with said ring gear and operatively joined to said pair of gears whereby reciprocation of said pistons is converted by the gear box to rotation of the rotatable means.

31. A power plant as set forth in claim 30, wherein the teeth in said ring gear are of an even number which is twice that of the teeth in each of the gears of said pair.

32. A power plant as set forth in claim 30, wherein said pins project from the respective pistons at points substantially midway of the length of said pistons.

33. A power plant as set forth in claim 30, wherein the teeth of said ring gear and the pair of gears are inclined with respect to the principal planes of the respective gears.

34. A power plant as set forth in claim 33, wherein said connecting means for each of the pins is joined to an inclined tooth of a respective one of the gears of said pair.

35. A power plant as set forth in claim 30, further comprising a turbine located on the opposite side of said engine from the gear box, said turbine comprising:

an impeller having vanes positioned adjacent to the exhaust ports to receive engine combustion gases when the ports are in registry with the sleeve valve apertures; and an output shaft joined to said impeller.

36. A power plant as set forth in claim 35, further comprising a ring of filter material located beyond the periphery of the impeller to receive said combustion gases after deflection by the impeller vanes.

37. A power plant as set forth in claim 36, further comprising an open-sided diffuser collar interposed between the impeller and the filter material, said collar including a plurality of spaced arcuate ribs positioned to diffuse combustion gases deflected from the impeller vanes and passing through said open sides to the filter material.

* * * * *